United States Patent [19]

Thompson

[11] 4,287,823

[45] Sep. 8, 1981

[54] SLUSH PULP BALER

[75] Inventor: Wallace M. Thompson, Cordele, Ga.

[73] Assignee: American Hoist & Derrick Company, St. Paul, Minn.

[21] Appl. No.: 102,350

[22] Filed: Dec. 11, 1979

[51] Int. Cl.[3] ..... B30B 9/06

[52] U.S. Cl. ..... 100/129; 100/218; 100/244; 100/295

[58] Field of Search ..... 100/35, 37, 116, 125, 100/126, 127, 128, 129, 110, 244, 218, 113, 115, 295; 206/83.5

[56] References Cited

U.S. PATENT DOCUMENTS

| | | | |
|---|---|---|---|
| 366,398 | 7/1887 | Jourdan | 100/127 X |
| 1,311,160 | 7/1919 | French | 100/127 |
| 1,867,137 | 7/1932 | Carver | 100/127 |
| 2,780,989 | 2/1957 | Guy | 100/218 |
| 4,102,259 | 7/1978 | Thompson et al. | 100/218 |

FOREIGN PATENT DOCUMENTS

| | | | |
|---|---|---|---|
| 2744381 | 4/1979 | Fed. Rep. of Germany | 206/83.5 |

*Primary Examiner*—Peter Feldman

*Attorney, Agent, or Firm*—Cushman, Darby & Cushman

[57] ABSTRACT

A press for forming self-supporting bales of fibrous material from a pulpy mass of the same having a high liquid content wherein the inner sides of the fixed walls of the baling chamber are provided with parallel narrow grooves having holes in their bottoms extending through the walls to the outside of the chamber. The pulpy mass creates rib-like formations in the grooves which block loss of solids but permit escape of liquid from the chamber. The grooves are parallel to the movement of the press head so the grooves are self-cleaning.

14 Claims, 5 Drawing Figures

SLUSH PULP BALER

BACKGROUND OF THE INVENTION

The invention relates to baling presses and, more particularly, to presses for forming self-supporting bales of fibrous material from pulpy fibrous material containing a high percentage of liquid, such as slush pulp, bagasse pith, etc.

Presses for dewatering and forming bales from materials having a high liquid content, such as pulp, are known. Exemplary of U.S. patents disclosing such presses are:

| | | |
|---|---|---|
| MacMurray | 2,697,979 | Dec. 28, 1954 |
| Denison et al | 2,711,686 | June 28, 1955 |
| Raab | 3,279,356 | Oct. 18, 1966 |
| Raab | 3,438,319 | Apr. 15, 1969 |
| Raab | 3,438,320 | Apr, 15, 1969 |

All such presses, however, possess disadvantages. Among such is that fibrous pulpy material of high liquid content cannot be handled satisfactorily because of inadequate drainage or filtering means for the baling chamber. Such drainage means either is clogged rapidly so that the liquid content of the material is not reduced sufficiently to permit baling of the solids, or the filtering apertures are so large that the pulpy material cannot be retained in the chamber without excessive solid losses. Further, existing presses for dewatering and baling material are unduly complicated and consequently expensive to construct and maintain. Additionally, many such presses are incapable of forming self-supporting bales so the baled product requires strapping.

SUMMARY OF THE INVENTION

Accordingly, it is an object of this invention to provide a simple, highly productive, press for dewatering and compacting, into a self-supporting bale, fibrous pulpy material having a high liquid content, especially slush pulp.

It is another object of this invention to provide such a press with novel effective drainage means which permits rapid escape of liquid from the baling chamber while retaining solids and which is non-clogging in use and seldom requires cleaning.

It is a further object of this invention to provide such a press which is effective to dewater and bale slush pulp without affecting the physical and chemical characteristics of the fibers and which is capable of producing bales of dry fibers having a density of the order of 30 lbs per cu. ft.

Other objects and advantages of the invention will become apparent from the following descriptions and accompanying drawings, in which:

DETAILED DESCRIPTION OF THE INVENTION

Figure 1:
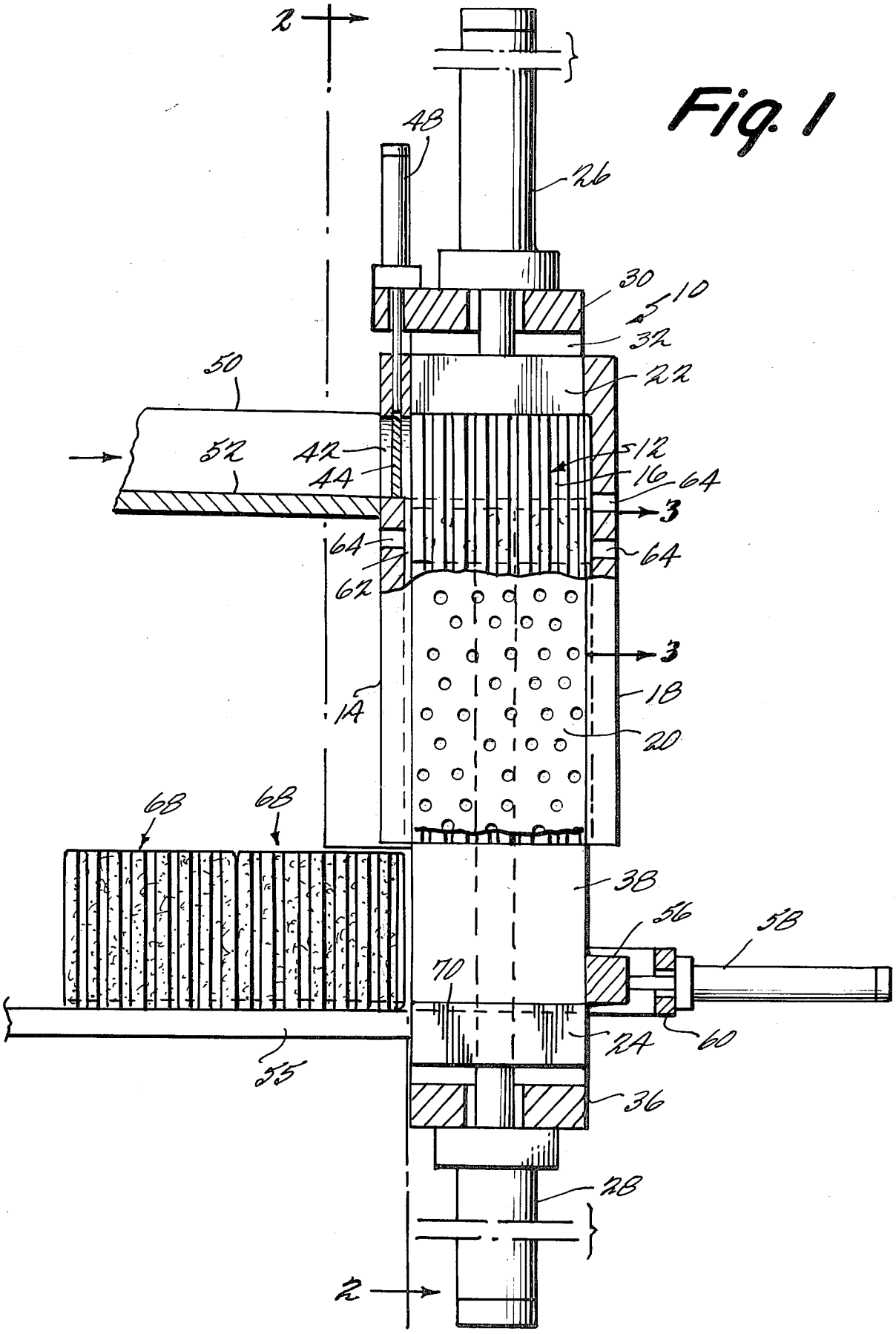
FIG. 1 is a somewhat schematic elevational view, partly in vertical section, of a baling press embodying this invention.
Figure 2:
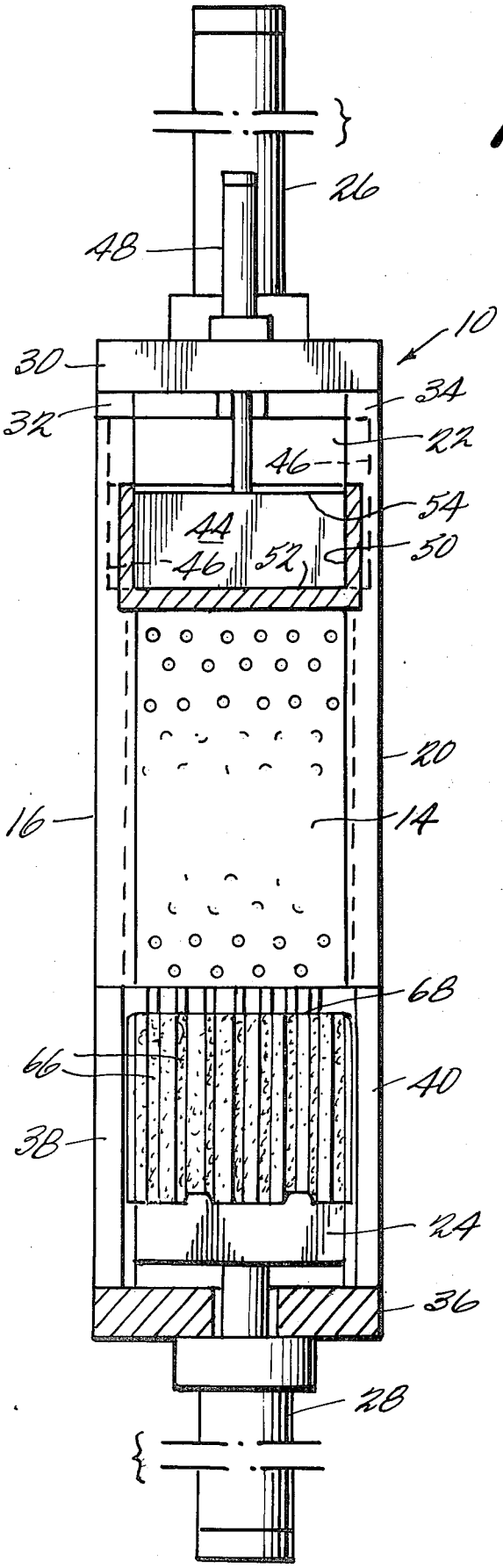
FIG. 2 is a side elevational view taken on line 2—2 of FIG. 1.

Referring now to the drawings, there is shown a press 10 embodying this invention for dewatering and baling fibrous material of high liquid content. The press 10 has a baling chamber 12, generally rectangular in horizontal section, provided with four fixed upright side walls 14, 16, 18, 20, a top wall 22 movable vertically in the chamber 12, and a bottom wall 24 movable vertically into and out of the chamber 12. The top and bottom walls 22 and 24 are movable by upright hydraulic rams 26 and 28, respectively. The cylinder of the upper ram may be mounted to a cross piece 30 bridging upper extensions 32 and 34 of the side walls 16 and 20, while the cylinder of the lower ram 28 may be mounted to a cross piece 36 bridging lower extensions 38 and 40 of the side walls 16 and 20. At the upper end of the chamber, one of the side walls, e.g., 14, is provided with an inlet opening 42 which is normally closed by a gate 44 that is vertically slidable between an upper open position and a lower closed position, as shown in FIGS. 1 and 2, in guiding grooves 46 at the opposite sides of the opening. The gate 44 may be moved between open and closed positions by an upright hydraulic ram 48 mounted to a lateral extension of the cross piece 30.

Mounted at one side of the press 10 adjacent the inlet opening 42 is a slush pulp head box 50, only a part of which is shown, having its floor 52 flush with the bottom of the inlet opening 42 and having a side opening 54 in direct communication with the inlet opening.

Secured to the lower side wall extensions 38 and 40 below and to one side of the baling chamber 12 is a bale slide 55. Opposite the slide 55 is a pusher or ejector head 56 operable by a horizontal hydraulic ejector ram 58 having its cylinder mounted to a U-shaped bracket 60 bridging the wall extensions 38 and 40.

Figure 3:
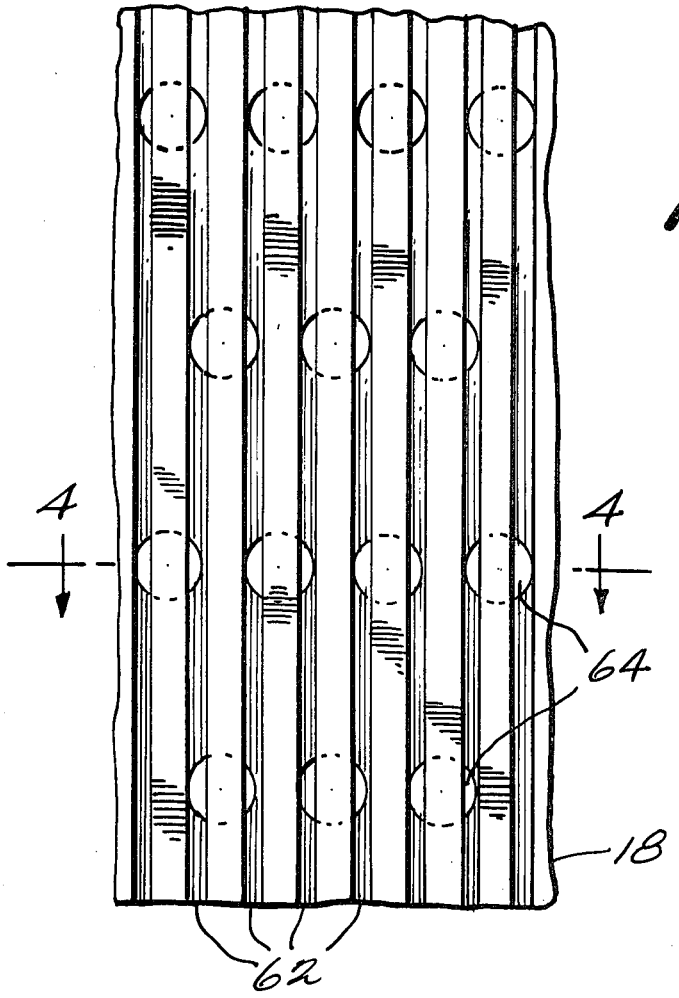
FIG. 3 is an enlarged fragmentary elevational view of the inner side of one of the side walls of the baling chamber taken on line 3—3 of FIG. 1.
Figure 4:
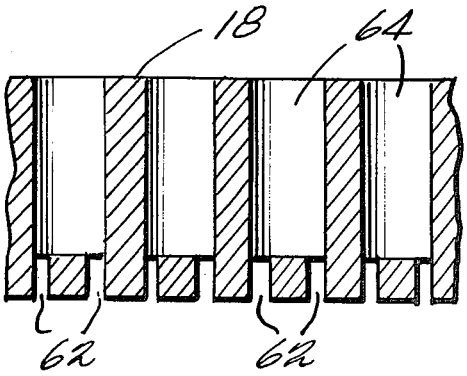
FIG. 4 is a sectional view taken on line 4—4 of FIG. 3.

Slush pulp has a very high liquid content, frequently more than 90%. Thus, in order to dewater such material for effective compaction and baling of the remaining solids, the baling chamber 12 must be provided with effective non-clogging means for rapidly draining away liquid in the chamber while retaining the solids to be compacted and baled. For this purpose the side walls 14, 16, 18 and 20 of the chamber 12 are provided on their inner sides with closely-spaced parallel narrow vertical generally-rectangular grooves 62, as best shown in FIGS. 3 and 4. For reasons later described, the depth of the grooves 62 is considerably more than their width, e.g., three times the width, while their actual width is governed to some extent by the dimensions of the fibrous solids to be baled, especially the length of the fibers. In actual practice, it has been found that grooves 62 having a width of the order of 1/16", a depth of the order of 3/16", with a spacing therebetween of the order of 3/16" perform the desired drainage and filtering functions for slush pulp. Drainage holes 64 in the side walls 14, 16, 18 and 20 communicate the bottoms of the grooves 62 with the exterior of the baling chamber 12. For grooves 62 of the aforementioned dimensions and spacing, circular holes 64 of a diameter of the order of 5/16" have been found to be satisfactory. The holes 64 preferably are arranged in staggered vertical rows with the hole centers midway of the lands between the grooves 62, so that each hole overlaps the bottoms of two adjacent grooves, with the holes spaced on about 2" centers in each row.

Figure 5:
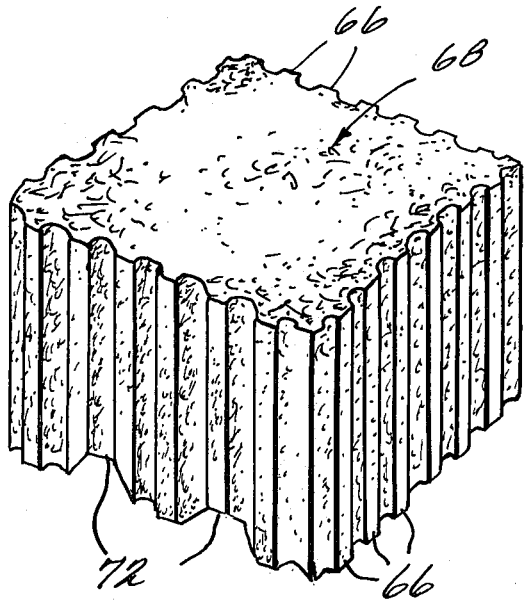
FIG. 5 is an enlarged perspective view of a bale made by the press.

In operation the bottom wall 24 is moved up by its ram 28 until it is level with the floor 52 of the slush-pulp head box 50, as shown in dashed lines in FIG. 1. Then, with the top wall 22 in its uppermost position, the gate 44 is opened by its ram 48 to allow slush pulp to flow from the head box 50 through the inlet opening 42 into the baling chamber 12 and into the upper lengths of the grooves 62 in the side walls of the chamber then exposed to the pulp. The narrowness of the grooves 62, however, blocks flow of the pulp solids completely into the bottoms of the grooves, so that flow of the pulp liquid continues but the pulp fibers are arrested in the outer portions of the grooves and create rib-like formations 66 in such outer portions which do not extend to the bottoms of the grooves. In fact, the height of the rib-like formations 66 is about equal to their width. Flow of liquid continues, however, through such rib-like formations 66 (FIG. 5) into the space between such formations and the bottoms of the grooves 62 and, thence, outwardly through the holes 64 to the exterior of the press 10 where the liquid is collected in appropriate troughs (not shown) connected to a suitable drain (not shown). The lower ends of the grooves 62 may be closed or alternatively left open to drain into the same or another trough (not shown).

On completion of the pulp flow, the bottom wall 24 may be lowered slowly by its ram 28 to the lower end of the baling chamber 12 to allow more slow inflow of pulp and more drainage of liquid through the grooves 62 and holes 64 with consequent downward elongation of the already formed rib-like formations 66 of fibers in the side wall grooves. The gate 44 is then moved to its closed position by its ram 48, and the top wall 22 moved down by its ram 26 to express more liquid from the pulp through the rib-like formations 66, for drainage through the grooves 62 and holes 64, and compact the dewatered fibers into a self-supporting bale 68. The bottom wall 24 then is moved to its lowermost position by its ram 28 and the top wall 22 moved down by its ram 26 along with the bottom wall to move the formed bale 68 into alignment with the slide 55. During lowering of the bale 68, the vertical rib-like formations 66 on its sides slide downwardly in the grooves 62 without detachment or shearing off from the bale so that the grooves are cleared of such formations for the next bale-forming cycle. In this connection the side wall lower extensions 38 and 40 are reduced in thickness from their inner sides at least to the bottom of the grooves 62, and preferably more. Thus, when the bale 68 is aligned with the slide 55, there will be no interengagement of the rib-like formations 66 on the bale with any grooves 62 to hinder lateral movement of the bale onto the slide.

After the bale 68 has been so lowered out of the baling chamber 12, the pusher head 56 of the ejector ram 58 is then moved transversely across the press 10 to eject the formed bale 68 onto the bale slide 55. The latter may consist of a horizontal plate, as shown or a downwardly inclined plate (not shown) to convey the formed bales 68 to a collection point (not shown). The ejector ram 58 is then retracted and the baling cycle is repeated.

Preferably the upper surface of the bottom wall 24 has a pair of spaced ribs 70 thereon parallel to the ejecting movement of the bales 68 for molding grooves or recesses 72 in the bottom of each bale 68 for the reception of the tines of the fork of a fork-lift truck (not shown). Thus, the bales 68 can be handled readily by a fork-lift truck without a pallet.

In actual tests, it has been found that the above-described press can dewater and compact slush pulp into self-supporting bales of fibers that require no strapping and which, after air drying, have a density of the order of 30 lbs. per cu. ft. with no appreciable change in the physical or chemical characteristics of the fibers in the pulp.

While the invention has been described with especial reference to the formation of bales of fibers from slush pulp, it will be realized that the invention is equally applicable for the dewatering and compacting of other fibrous materials having a high liquid content, such as begasse pith. In that case, due regard must be given to the nature and dimensions of the fibers for proper sizing of the grooves 62 and holes 64 to achieve the desired results of creating rib-like formations of the fibers in the grooves to prevent loss of fibers from the baling chamber 12 while permitting escape of liquids.

It thus will be seen that the objects and advantages of this invention have been fully and effectively achieved. It will be realized, however, that the foregoing specific embodiment has been disclosed only for the purpose of illustrating the principles of this invention and is susceptible of modification without departing from such principles. Accordingly, the invention includes all embodiments encompassed within the spirit and scope of the following claims.

I claim:

1. In a press for forming self-supporting bales of fibrous material from pulpy masses of the same containing a high percentage of liquid, such as slush-pulp, the combination comprising:

means defining a closed baling chamber having at least a pair of opposed generally rectangular walls, one of which is movable toward the other to compress material in said chamber, and having at least a third fixed wall along which said one wall is movable; and drainage means for liquid in said chamber comprising a plurality of narrow grooves in the inner sides of said third wall extending in the direction of movement of said one wall, the mouth of each of said grooves being of uniform width throughout its length and at least as wide as the width of said groove inwardly of said mouth, and spaced holes in said third wall unobstructedly and directly communicating the bottoms of said grooves, at spaced intervals therealong, with the exterior of said chamber, said third wall being of generally uniform thickness throughout except for said grooves and holes, whereby fibrous solids in fibrous material having a high liquid content in said chamber form rib-like formations in said grooves that block passage of fibrous solids through said holes but permit liquid to drain through said rib-like formations and through said holes, and the rib-like formations are and remain integral with a bale formed in said chamber on removal of such bale from said chamber by movement in said direction.

2. The combination defined in claim 1 wherein the third wall is upright and the one wall moves vertically.

3. The combination defined in claim 1 in which the grooves are of narrower width than depth whereby the rib-like formations are spaced from the bottom of the grooves for flow of liquid between the formations and said groove bottoms.

4. The press defined in claim 3 adapted to form bales from slush pulp having a liquid content at least of the order of about 90%, wherein:

the groove width is of the order of 1/16", depth of the order of 3/16", and space therebetween of the order of 3/16".

5. The press defined in claim 4 wherein the holes are circular, of a diameter of the order of 5/16", and have centers located midway of the space between adjacent grooves whereby one hole overlaps the bottom of a pair of adjacent grooves.

6. The press defined in claim 5 wherein the holes are disposed in staggered rows, each extending along a pair of adjacent grooves with the spacing between the holes in each row being of the order of 2" center-to-center.

7. A press for forming self-supporting bales of fibrous material from a pulpy mass of the same having a high liquid content comprising:

means defining a baling chamber having fixed upright side walls and generally-rectangular top and bottom walls movable vertically toward and away from each other, said bottom wall being movable downwardly out of said chamber;

ram means for moving said top and bottom walls;

drainage means for liquid in said chamber comprising apertures extending through at least one of said side walls;

means defining an inlet opening in an upper portion of one of said side walls for allowing a pulpy fibrous mass to flow into said chamber from a source of said mass; and gate means for closing said inlet opening;

whereby with said top wall in an upper position above the lower edge of said inlet opening and said bottom wall closing the bottom of said chamber, said gate means can be opened to permit a pulpy fibrous mass to flow into said chamber, said gate means can be closed, said top wall moved down to express liquid from the mass for flow through said drainage means and to compress the deliquidated fibrous material into a self-supporting bale, and said bottom wall moved downwardly out of said chamber along with downward movement of said top wall to move the formed bale out of said chamber;

wherein the drainage means comprises a plurality of narrow, vertical grooves in the inner side of the one side wall, the mouth of each of said grooves being of uniform width throughout its length and at least as wide as the width of said groove inwardly of said mouth, and spaced holes in said one side wall unobstructedly and directly communicating the bottoms of said grooves, at spaced intervals therealong, with the exterior of the chamber, said one side wall being of generally uniform thickness throughout except for said grooves and holes, whereby fibers in a fibrous pulpy mass in said chamber create rib-like formations in said grooves that block passage of fibers through said holes but permit liquid to drain through said formations and through said holes, and the rib-like formations are and remain integral with a bale formed in said chamber on movement of such bale downwardly out of said chamber.

8. The press defined in claim 7 in which the source comprises a head box in communication with the inlet opening for gravity flow of the mass from said box into the chamber.

9. The press defined in claim 7 including pusher means disposed below and to one side of the baling chamber for pushing a formed bale laterally off the bottom wall when the latter is in its lower position outside said chamber.

10. The press defined in claim 9 including a bale slide opposite the pusher means.

11. The press defined in claim 7 including a pair of rib-like projections on the bottom wall for molding a pair of grooves in the underside of the bale for receiving the tines of the fork of a fork-lift truck.

12. The combination defined in claim 7 in which the grooves are of narrower width than depth whereby the rib-like formations are spaced from the bottom of the grooves for flow of liquid between the formations and said groove bottoms.

13. The press defined in claim 12 adapted to form bales from slush pulp having a liquid content at least of the order of about 90%, wherein:

the groove width is of the order of 1/16", depth of the order of 3/16", and space therebetween of the order of 3/16".

14. The press defined in claim 13 wherein the holes are circular, of a diameter of the order of 5/16", and have centers located midway of the space between adjacent grooves whereby one hole overlaps the bottom of a pair of adjacent grooves.

* * * * *